US010960958B2

(12) United States Patent
Sharp

(10) Patent No.: US 10,960,958 B2
(45) Date of Patent: Mar. 30, 2021

(54) DEVICE AND METHOD FOR SECURING A WATERCRAFT

(71) Applicant: Robert John Sharp, Camarillo, CA (US)

(72) Inventor: Robert John Sharp, Camarillo, CA (US)

( * ) Notice: Subject to any disclaimer, the term of this patent is extended or adjusted under 35 U.S.C. 154(b) by 112 days.

(21) Appl. No.: 15/673,415

(22) Filed: Aug. 9, 2017

(65) Prior Publication Data

US 2018/0319467 A1 Nov. 8, 2018

Related U.S. Application Data

(60) Provisional application No. 62/374,869, filed on Aug. 14, 2016.

(51) Int. Cl.

| | |
|---|---|
| ***B63B 35/28*** | (2006.01) |
| ***B63B 59/02*** | (2006.01) |
| ***E02B 3/26*** | (2006.01) |
| *B63B 1/04* | (2006.01) |

(52) U.S. Cl.

CPC ..... *B63B 59/02* (2013.01); *B63B 35/28* (2013.01); *E02B 3/26* (2013.01); *B63B 2001/045* (2013.01)

(58) Field of Classification Search

CPC ..... B63B 59/02; B63B 35/28; E02B 3/26

See application file for complete search history.

(56) References Cited

U.S. PATENT DOCUMENTS

| | | | | |
|---|---|---|---|---|
| 3,938,676 | A * | 2/1976 | Croese | B63B 27/00 414/138.6 |
| 4,361,104 | A * | 11/1982 | Lloyd, III | B63B 35/44 114/258 |
| 4,483,655 | A * | 11/1984 | Snow | B63B 27/22 414/137.9 |
| 4,938,163 | A * | 7/1990 | Capron | B63B 35/70 114/219 |
| 4,979,453 | A * | 12/1990 | Sloan | E02B 3/064 114/263 |
| 5,125,355 | A * | 6/1992 | Stranzinger | B63B 35/38 114/218 |
| 6,834,604 | B2 * | 12/2004 | O'Neil | B63C 1/02 114/44 |
| 7,055,447 | B1 * | 6/2006 | Bekker | B63B 27/30 114/151 |
| 7,302,902 | B2 * | 12/2007 | Stillman | B63B 35/34 114/263 |
| 7,641,526 | B1 * | 1/2010 | Bekker | B63H 5/125 440/54 |

(Continued)

*Primary Examiner* — S. Joseph Morano
*Assistant Examiner* — Jovon E Hayes

(57) ABSTRACT

In accordance with one embodiment, a servicing watercraft that may be safely secured to a serviced watercraft. The servicing watercraft comprises at least one auxiliary section that may be positioned to either a) increase the effective width of the servicing watercraft thus reducing rolling motion while the servicing watercraft is stationary or in operation, OR b) decrease the width of the servicing watercraft thus reducing drag while the watercraft is moving through the water. Furthermore, the auxiliary section(s) help the servicing watercraft to be positioned in an optimum location adjacent to the serviced watercraft as to avoid impact from accidently dropped cargo or shipping containers from the serviced watercraft.

1 Claim, 11 Drawing Sheets

(56) References Cited

U.S. PATENT DOCUMENTS

| | | | | |
|---|---|---|---|---|
| 7,985,108 | B1 * | 7/2011 | Bekker | B63H 5/125 440/5 |
| 9,156,526 | B2 * | 10/2015 | Handley | B63B 7/02 |
| 9,308,973 | B2 * | 4/2016 | Teppig, Jr. | B63B 27/36 |
| 9,341,028 | B2 * | 5/2016 | Buckingham | E21B 15/006 |
| 9,347,611 | B2 * | 5/2016 | Ryu | F17C 3/027 |
| 9,643,691 | B2 * | 5/2017 | Teppig, Jr. | B63B 27/36 |
| 2012/0057938 | A1 * | 3/2012 | Tanguay | E02B 3/068 405/219 |
| 2016/0200406 | A1 * | 7/2016 | Schaefer | B63B 59/02 114/361 |

* cited by examiner

VIEW FROM REAR

VIEW FROM REAR

DEVICE AND METHOD FOR SECURING A WATERCRAFT

CROSS-REFERENCE TO RELATED APPLICATIONS

This application claims the benefit of PPA Ser. No. 62/374,869, filed 2016 Aug. 14 by the present inventor, which is incorporated by reference.

FEDERALLY SPONSORED RESEARCH

None.

SEQUENCE LISTING

None.

BACKGROUND

Watercraft that provide services to other watercraft at berth, at anchorage, or underway include, for example, bunkering (fueling) tankers/barges, supply vessels/barges, and emissions control vessels/barges. A servicing watercraft is traditionally positioned side-by-side with a serviced watercraft. Once the two watercraft are secured together, services or operations may begin.

In the case of fueling operations or bunkering operations, operations consist of attaching at least one hose from the servicing watercraft to the serviced watercraft so that fuel and/or oil may be transferred. In the case of supply operations, operations consist for transferring materials and/or supplies between the two watercraft. In the case of emissions control watercraft, operations consist of attaching at least one hose to draw exhaust gas from a serviced watercraft through the hose to an emissions treatment system located on a servicing watercraft to remove contaminants from the exhaust gas before release into the atmosphere.

However, I have encountered four problems that frequently arise during these operations. These problems are described below:

Problem 1: In the case where a servicing watercraft is positioned side-by-side with a serviced watercraft which is a cargo ship in this example, there is a danger that cargo may accidentally fall off the serviced watercraft and impact the servicing watercraft that is operating below. This is a potential danger to the servicing watercraft and personnel. Cargo can weigh more than 65,000 pounds and can fall a distance exceeding 75 feet. Falling cargo has been known to sink servicing watercraft operating alongside.

The superstructure of serviced watercraft typically contains crew's quarters, wheelhouse/bridge, fuel connections, oil connections, and exhaust pipes. On cargo ships, the cargo sections typically occupy the space immediately fore and/or aft of the superstructure. If a servicing watercraft is secured side-by-side with the serviced watercraft near the superstructure of a serviced watercraft, then any part of the servicing watercraft that extends either before or aft the superstructure of the serviced watercraft is in danger of being impacted by falling cargo such as shipping containers from above.

Inserting a spacer between a servicing watercraft and a serviced watercraft in an attempt to place the servicing watercraft a safe distance away from the serviced watercraft does not solve the problem. In the case when the serviced vessel is a containership, when a shipping container falls from the serviced watercraft, it will likely fall away from the vessel, not vertically straight down. When a shipping container falls, it usually impacts the water more than fifteen feet from the side of the serviced watercraft. This means that a spacer is only effective if the shipping container were to fall directly down the side of the serviced watercraft, which rarely happens. The most common cause for a shipping container falling from a serviced watercraft is when another container within the same row of containers is knocked sideways thus starting a chain reaction, knocking container to container, which eventually results in a container being knocked overboard. The sideways force from being knocked over provides the momentum to launch the container away from the vessel. By the time the container reaches the water, its sideways momentum has carried it more than fifteen feet away from the side of the serviced watercraft. Therefore, a disadvantage of using a spacer is that it does not appreciably reduce the danger of cargo falling onto the servicing watercraft unless the spacer dimension is greater than about 50 feet. Even if the spacer dimension is sufficient to prevent the cargo from impacting the servicing vessel, it still impacts the spacer, which is still a significant problem and can still indirectly cause damage or injury.

Another disadvantage of using a spacer is that it increases the distance between servicing watercraft and serviced watercraft by a significant distance. In the case of an emissions control barge, the arm or crane would then be required to accommodate this additional reach. The arms on emissions control barges already have difficulty reaching the center of the vessel where the exhaust pipes are located at the top of the superstructure, especially on wider vessels. The reach of an arm is typically one of the major limiting physical factors on an emissions control barge. Therefore, the additional reach imposed by the spacer significantly reduces the reach capability of the arm, with the resulting disadvantage that the servicing watercraft may not being able to service larger vessels. The same disadvantage applies to fuel, oil, and supply servicing watercraft that use a crane to support the transfer hose, thus the crane may not be able to reach across the spacer.

Yet another disadvantage of using a spacer is that it requires that the spacer must be stored, moved, transported, and manipulated into position. A spacer has a disadvantage of increased cost from storage fees for the spacer when not in use. A further disadvantage is the additional cost that is incurred when a spacer requires more than one tugboat to position the spacer alongside a servicing watercraft. A further disadvantage is the additional time required to move, transport, and position a spacer which increases costs and increases the amount of time it takes to connect to a serviced vessel.

Yet another disadvantage using a spacer is that it causes a servicing watercraft to be positioned further into the channel by an additional amount equal to the width of the spacer. This additional width can interfere with the navigation of passing vessels, especially in narrow channels.

Problem 2: Another problem experienced when servicing watercraft are secured to serviced watercraft is excessive relative movement between the watercraft. In an example of an emission control watercraft, a servicing watercraft may have a tall tower and an arm mounted on top of the tower where it is very important that the servicing watercraft be as stable as possible in the water to limit the amount of translation at the top of the tower and arm. A tower on an emissions control watercraft may be about 100 feet tall and an arm on top of the tower may be about 125 feet. In this example, the distance from the center of rotation of the servicing watercraft to the tip of the arm would be about 160 feet. The translational motion of the end of the arm would be approximately 3 feet per degree of rolling motion of the watercraft, which is significant. Thus, even a small amount of rolling motion of the servicing watercraft can translate into a significantly large translational movement at the far end of the tower and arm. Too much relative motion between the watercraft could result in damage to connecting equipment or collision between some aspect of the serviced watercraft and the tower and/or arm of servicing watercraft. Furthermore, too much relative motion could also result in damaging the connection device or connecting ducting, especially considering that the serviced watercraft may be moving independently as well, thereby increasing the potential relative motion.

The amount of rolling motion associated with a watercraft is inversely proportional to the width of the watercraft. For example, in the case of a long and slender watercraft, the watercraft will tend to roll in about the axis of the longitudinal direction. A wider watercraft experiences less rolling motion. Therefore, watercraft such as such as those typically used for emissions control will roll significantly along the longitudinal axis because these watercrafts are typically several times longer than they are wide.

The rolling motion of typical watercraft is a significant problem in waters that have large swells, wakes, or waves such as is the case outside of a harbor or outside of a breakwater. Typical watercraft therefore have a disadvantage of not being able to service vessels outside of a harbor, outside of a breakwater, or in locations within a harbor that have larger swells or narrow channels in which passing vessels cause significant water movement.

Simply building a wider watercraft does not adequately solve the problem. One disadvantage of increasing the dimensions of a watercraft is increased cost due to increased amount of materials required. Another disadvantage of a wider watercraft is that it is harder to push the watercraft through the water due to drag. Typically, a slender hull shape is the most advantageous in terms of reducing resistance (drag) through the water. This increased resistance (drag) results in a disadvantage of increased fuel costs. Yet another disadvantage of increasing the width of a watercraft is that it may difficult to navigate through narrow channels. Yet another disadvantage of a wider watercraft is that the width of the watercraft may protrude into a narrow waterway too much while in operation thus interfering with the navigation of other passing vessels.

Yet another disadvantage of a wider watercraft is that, in the case of an emissions control watercraft, a wider watercraft translates to a longer reach to the center of the watercraft for connection to the exhaust pipes, which would limit the width of the serviced watercraft that could be reached. When both watercrafts are positioned side-by-side, as in the examples of an emissions control watercraft or a fueling/bunker watercraft, an arm is used by the servicing watercraft to reach the serviced watercraft. Typically, the arm or crane is located along the centerline of the servicing watercraft in order that a serviced watercraft may be reached from either the port side or starboard side of the servicing watercraft. The arm is therefore required to span half the width of the servicing watercraft before entering the space of the serviced watercraft. Therefore, a wider servicing watercraft imposes a reach deficit equal to half the width of the servicing watercraft. Thus, a disadvantage a servicing watercraft built with additional width is reduced net arm reach, resulting in a limitation of the width of serviced watercraft that can be served.

Problem 3: A servicing watercraft usually needs to be placed adjacent to the superstructure (house) of a serviced watercraft because the superstructure of the serviced watercraft is typically directly above the engine room, thus this is where fuel connections, supply cranes, and exhaust pipes are typically located. On many vessels, the superstructure is located near the stern (rear) of the vessel. This is most frequently true on non-containerships such as bulk carriers, tankers, Roll on/Roll off (RoRo's), and auto carriers. If a serviced watercraft is lightly loaded and therefore sits high in the water, the stern (the run) has a sharp rake (a rounded incline from perpendicular) and there is not a vertical flat area (sheer strakes) where the vessel can securely come alongside for coupling. In response to this situation, a large floating fender (a large inflated balloon-like bumper) has been used to fill the irregular gap between a servicing vessel and a non-vertical side of a serviced vessel. U.S. Pat. No. 3,063,400A by Yamaguchi Minoru and Kobayashi Takashi, dated Aug. 17, 1960, and assigned to Yokohama Rubber Co Ltd, is an example of this approach. These floating fenders are typically referred to in the industry as "Yokohamas". However, a disadvantage of this common approach that it is inconvenient, complicated, time-consuming, and requires constant attention as vessel cargo is loaded and unloaded. Another disadvantage of this approach is that a serviced vessel may rise even further during the operation due to cargo unloading and/or reduction in ballast, the amount vertical flat area available may become critically limited and/or the gap between the vessels may become excessively large, which may create an unsafe coupling situation.

Problem 4: Frequently two servicing watercrafts need to be positioned near the same location on the same serviced vessel at the same time. One of many examples of this is when an emissions control barge is operating and a bunkering (fueling) barge arrives and must also be positioned next to the superstructure. Since both servicing vessels cannot be side-by-side with the serviced vessel in the same location at the same time, the emissions control barge is forced to disconnect and be moved elsewhere until the bunkering (fueling) operations have completed. One disadvantage of this is that the pollution control barge cannot reduce pollution during the time that the bunkering barge is in use. Another disadvantage is that the emissions control barge is wasting energy and manpower during the time that the bunkering barge is in use, which is costly.

SUMMARY

In accordance with one embodiment, a servicing watercraft that may be safely secured to a serviced watercraft. The servicing watercraft comprises at least one auxiliary section that may be positioned to either a) increase the effective width of the servicing watercraft thus reducing rolling motion while the servicing watercraft is stationary or in operation, OR b) decrease the width of the servicing watercraft thus reducing drag while the watercraft is moving through the water. Furthermore, the auxiliary section(s) help the servicing watercraft to be positioned in an optimum location adjacent to the serviced watercraft to avoid impact from accidently dropped cargo or shipping containers from the serviced watercraft.

DRAWINGS—FIGURES

The novel features which are characteristic of the present invention are set forth in the appended claims. However, embodiments, together with further objects and attendant advantages, will be best understood by reference to the following detailed description taken in connection with the accompanying drawings in which:

DETAILED DESCRIPTION

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

The details of one or more embodiments of the invention are set forth in the accompanying drawings and the description below. Other features, objects, and advantages of the invention will be apparent from the description and drawings, and from the claims.

Figure 1:
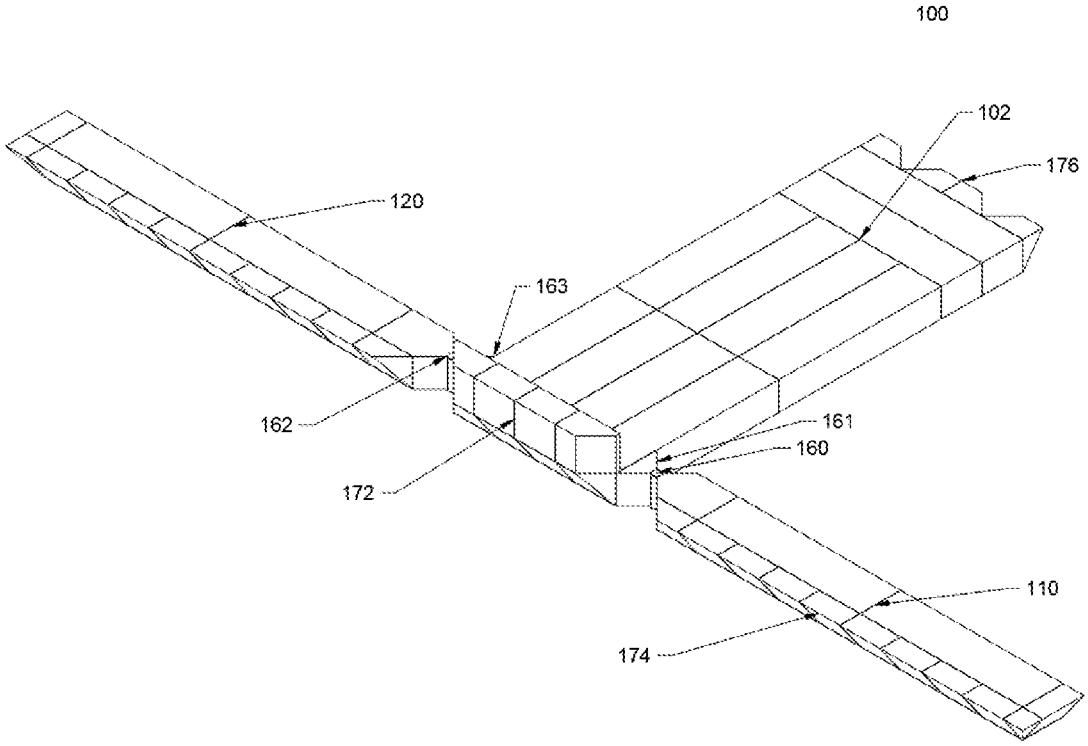
FIG. 1 shows a servicing watercraft with auxiliary sections (wings) deployed.

FIG. 1 shows one exemplary embodiment of a servicing watercraft (hereafter referred to as barge 100) with servicing watercraft main section 102 connected to port auxiliary section (hereafter referred to as wing 110) and starboard auxiliary section (hereafter referred to as wing 120). Wing 110 and wing 120 are approximately fifteen feet wide including the attached fender. Wing 110 rotates about pivot 160 and wing 120 rotates about pivot 162. In another example embodiment, the wings could be separate floating sections that are only loosely attached, without a pivot. FIG. 1 shows the case where wing 110 and wing 120 are both deployed (rotated away from main section 102). Each wing may be positioned, as one of many examples, within zero to 180 degrees or more about its pivot. Pivot 160 attaches to main section 102 via support 161. Pivot 162 attaches to main section 102 via support 163.

Pivot 160 and pivot 162 are preferably located significantly above the waterline such that these devices are not directly exposed to the body of water in which the watercraft sit. The pivots are built with materials that are suitable for the marine environment and are sufficiently corrosion resistant. The pivots are reinforced with sufficient structure to distribute the forces encountered during operation between main section 102 and wing 110 and wing 120.

Fender 172 is attached to the bow of main section 102. Fender 176 is attached to the stern of main section 102. In a similar fashion, fender 174 is attached to wing 110 and to wing 120.

Support 161 and support 163 are rigidly attached to main section 102 and are sufficiently strong to react against the forces produced by the wings when barge 100 is subject to swells and waves.

Figure 2:
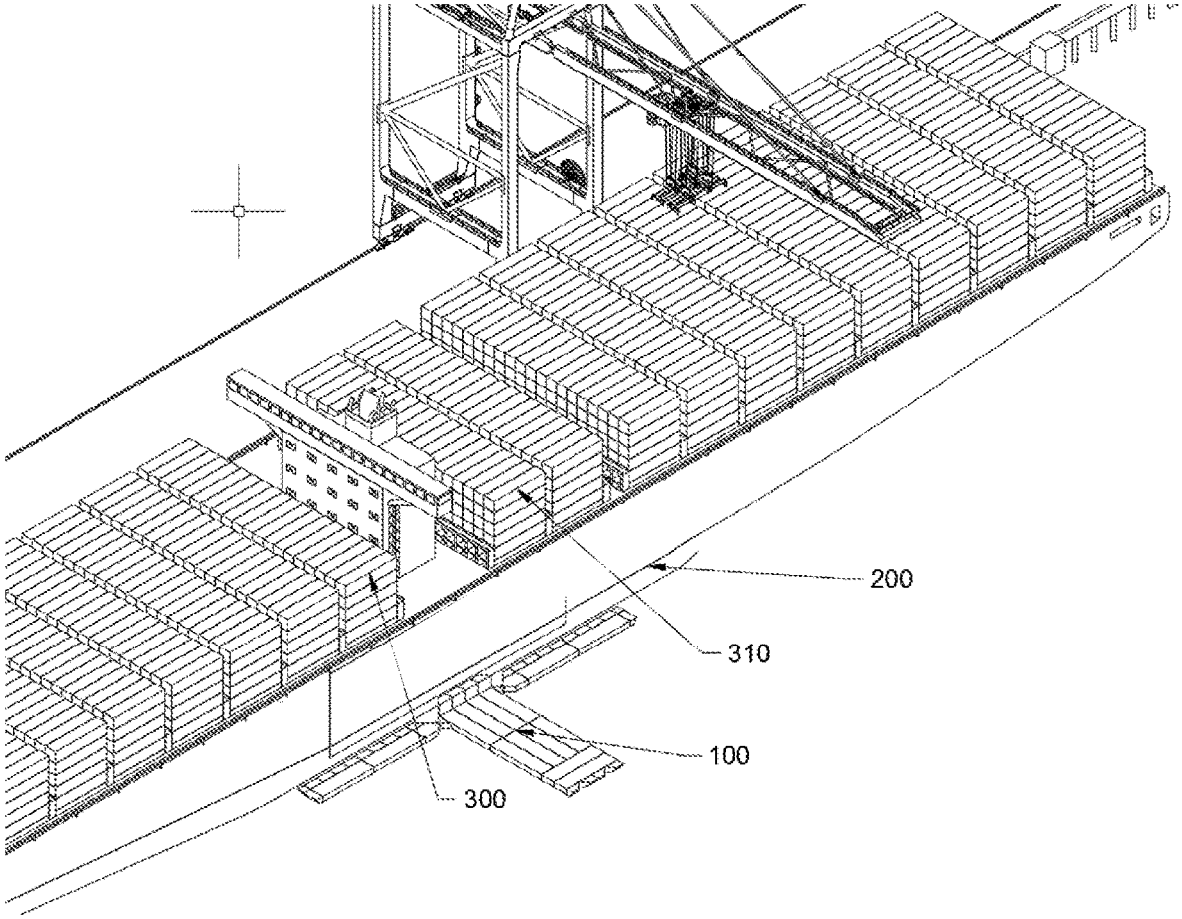
FIG. 2 shows a servicing watercraft positioned next to a serviced watercraft with auxiliary sections (wings) deployed.

FIG. 2 shows one exemplary embodiment of barge 100 positioned directly adjacent to a superstructure of serviced watercraft (hereafter referred to as vessel 200). FIG. 2 also shows and example where wing 110 and wing 120 deployed such that each wing makes contact with vessel 200.

Figure 3:
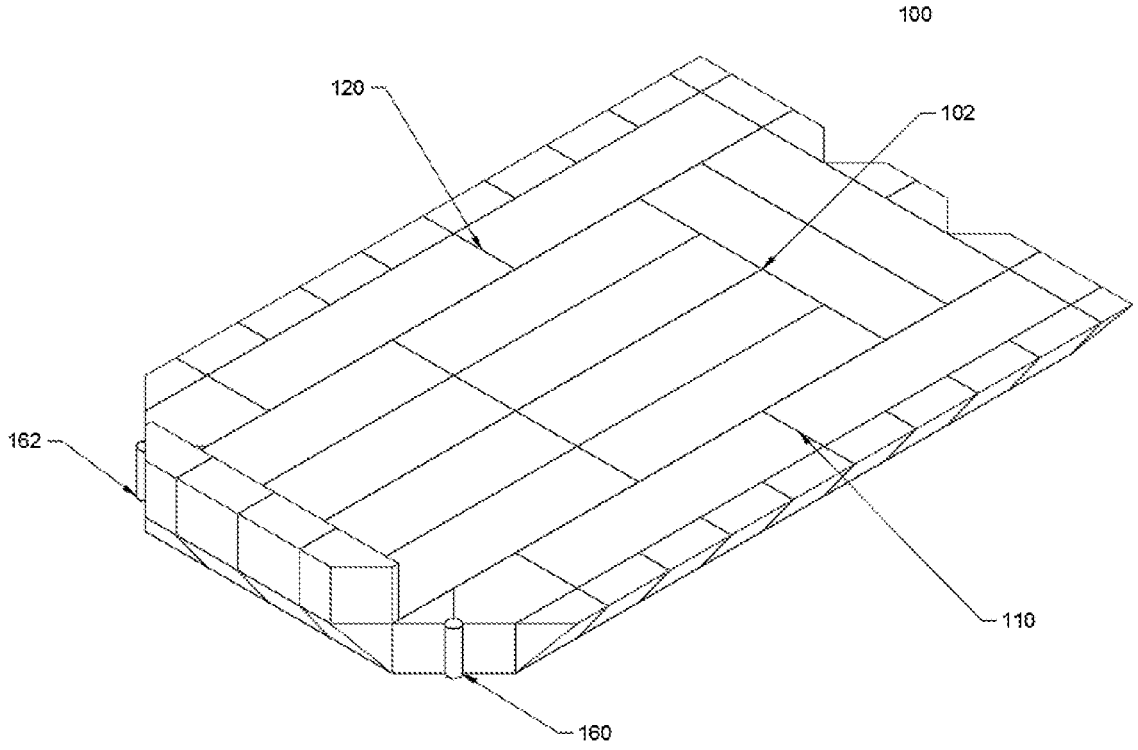
FIG. 3 shows a servicing watercraft with auxiliary sections (wings) stowed.

FIG. 3 shows one exemplary embodiment of barge 100 with wings alongside (stowed). In this configuration, starboard wing 110 and port wing 120 are rotated about pivots 160 and 162, respectively, such that the wings make contact with main section 102. The wings may be secured to main section 102 by means of a suitable latching mechanism or tied with a line, cable, or rope. In this mode of operation, the width of barge 100 is minimized and resembles a typical barge without wings.

Figure 4:
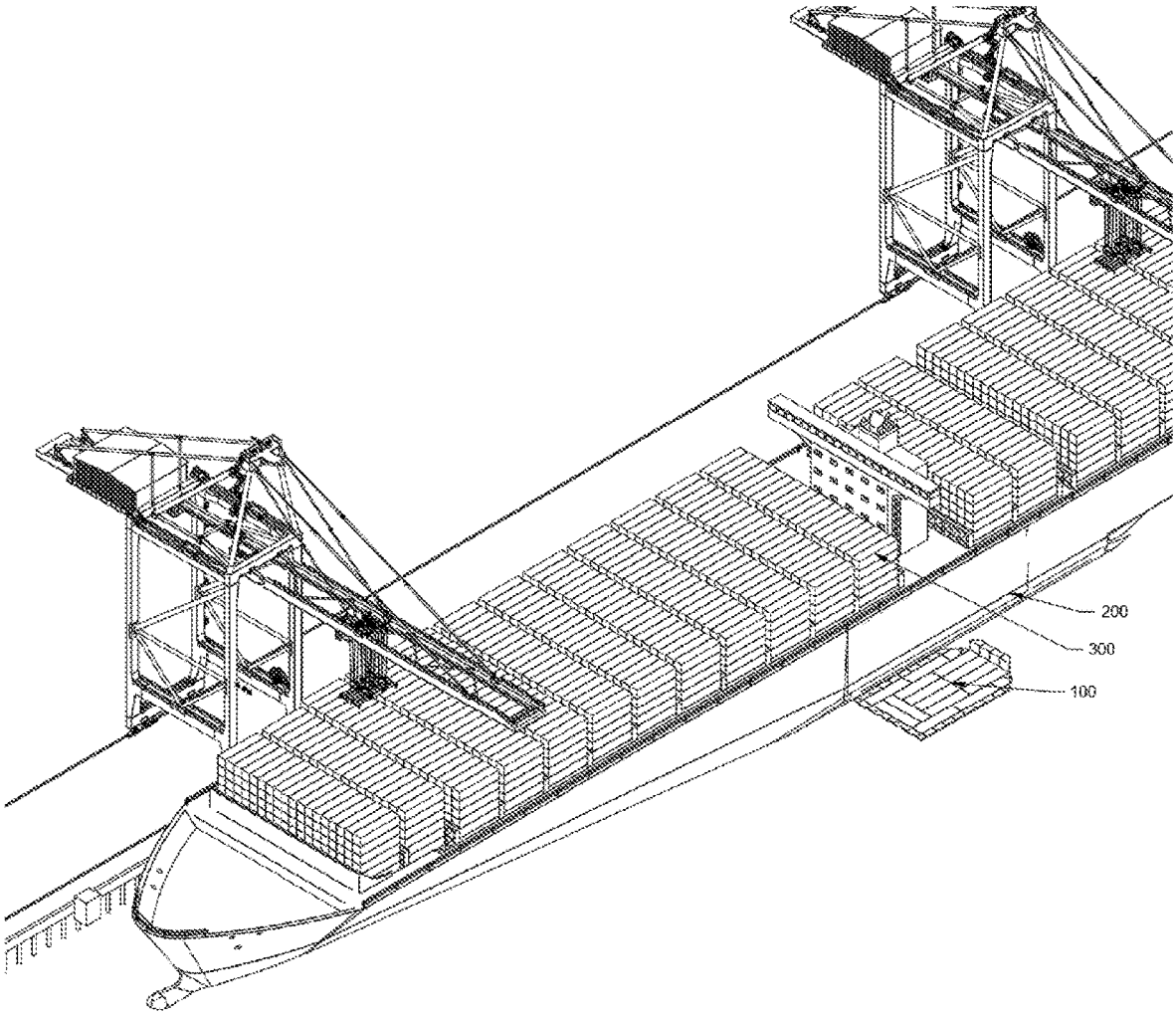
FIG. 4 shows a servicing watercraft positioned side-by-side with a serviced watercraft.

FIG. 4 shows servicing barge 100 side-by-side with vessel 200 with example cargo 300 looming above barge 100.

Figure 5:
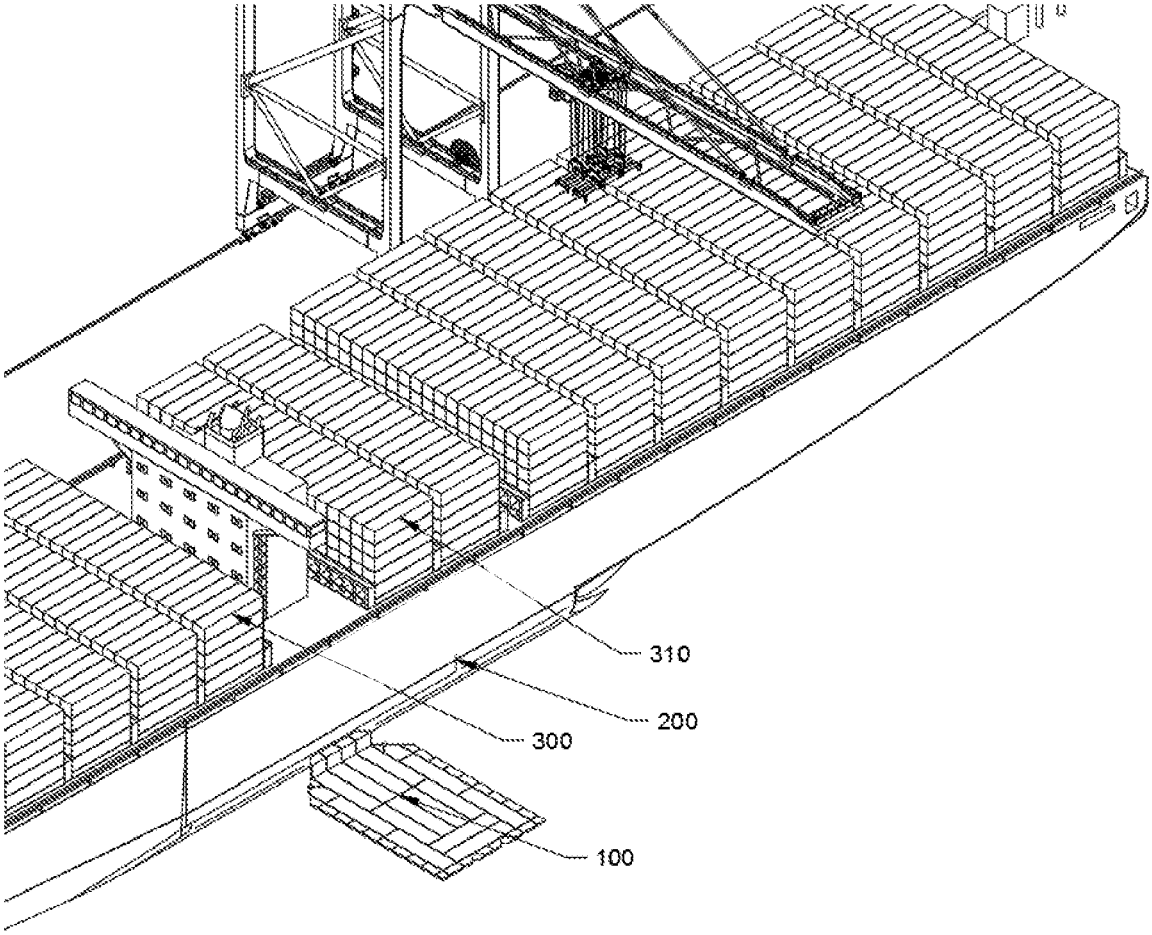
FIG. 5 shows a servicing watercraft positioned perpendicular to a serviced watercraft.

FIG. 5 shows servicing barge 100 perpendicular to vessel 200 and aligned with superstructure 210 of vessel 200 with example cargo 300 and example cargo 310 located to each side of barge 100.

Figure 6:
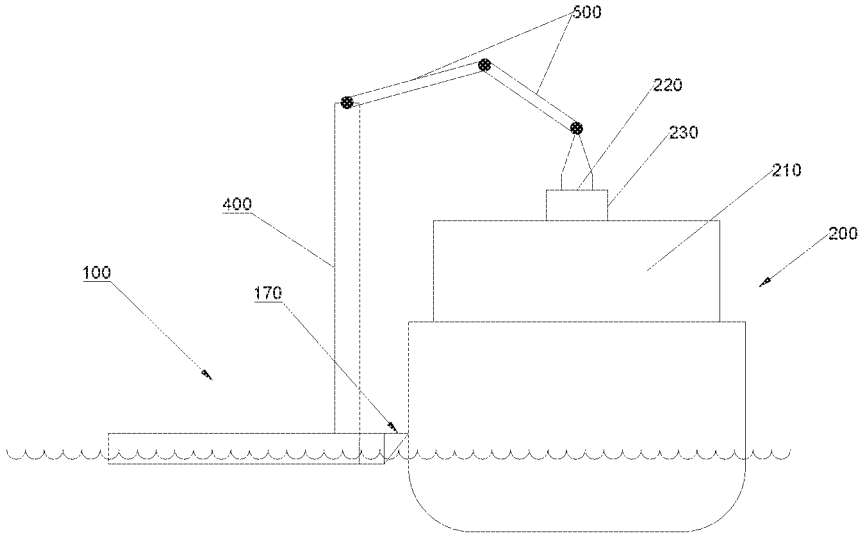
FIG. 6 shows an emissions control barge example.

FIG. 6 shows an example emissions control barge 100 servicing vessel 200. Tower 400 is mounted on barge 100 and arm 500 is mounted on tower 400. Exhaust pipes 220 are located on top of funnel 230 which is located adjacent to or on top of superstructure 210.

Figure 7:
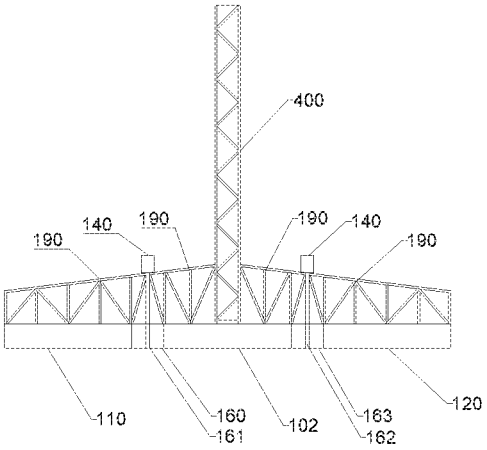
FIG. 7 shows a vertical structure example.

FIG. 7 shows example vertical structure 190 mounted on top of main section 102, wing 110, and wing 120. In one exemplary embodiment, vertical structure 190 may be integrated with pivot 160, pivot 162, support 161, support 163, and tower 400. FIG. 7 further shows an exemplary embodiment of rotary actuator 140 that connects to wing 110 via pivot 160 and to wing 120 via pivot 162.

Figure 8:
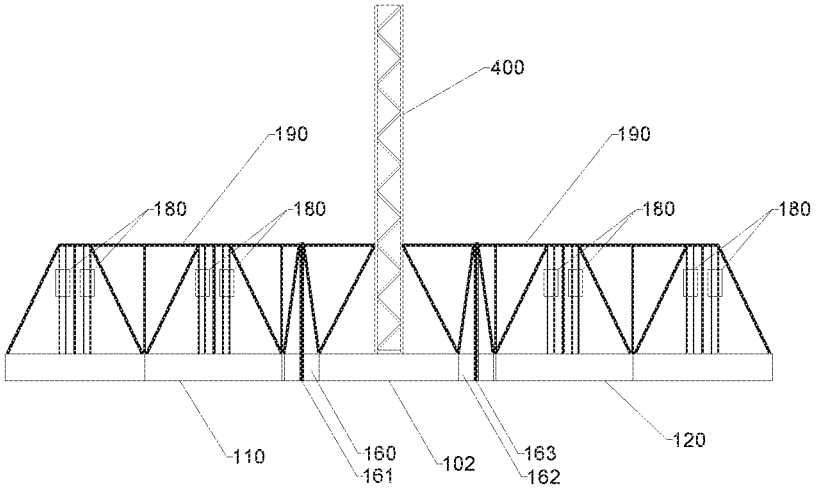
FIG. 8 shows a vertical structure with sliding attractive force attachment elements.

FIG. 8 shows another exemplary embodiment of vertical structure 190 wherein sliding attractive force attachment elements 180 are integrated into vertical structure 190.

Figure 9:
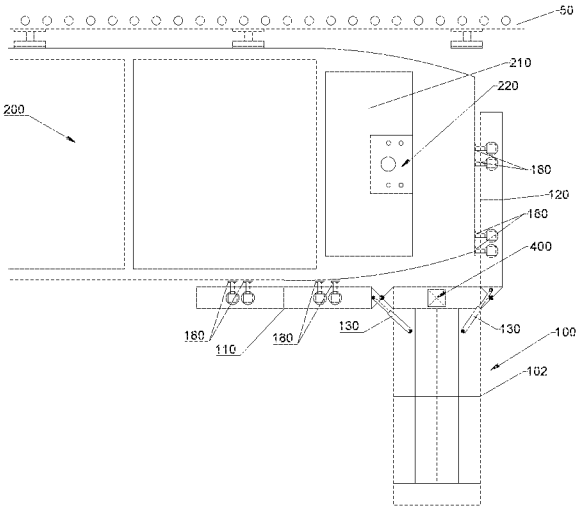
FIG. 9 shows wings deployed at 90 and 180 degrees.

FIG. 9 shows yet another exemplary embodiment with barge 100 configured with two auxiliary sections, wing 110 and wing 120. Wing 110 is shown positioned by hydraulic cylinder 130 to a 90-degree orientation. Wing 120 is shown positioned by hydraulic cylinder 130 to a 180-degree orientation. Barge 100 is shown next to vessel 200 and aft of superstructure 210. In this exemplary embodiment, barge 100 is secured to vessel 200 by means of attractive force attachment elements 180, although lines could be used instead. Vessel 200 is shown berthed next to wharf 50 in this figure.

Figure 10:
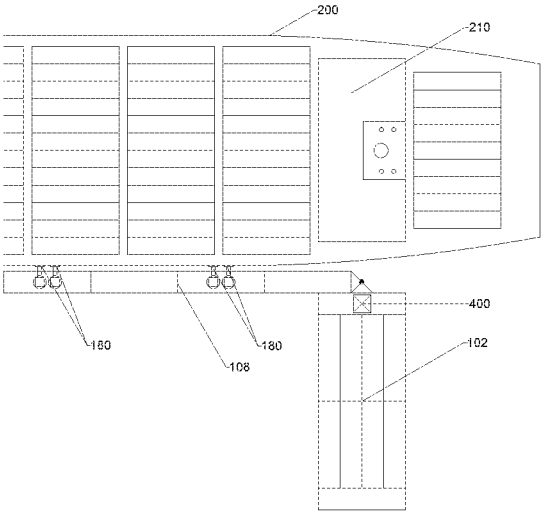
FIG. 10 shows an embodiment with a single auxiliary section.

FIG. 10 shows yet another exemplary embodiment with barge 100 configured with a single auxiliary section 108. Barge 100 is shown in this example with barge main body 102 adjacent to superstructure 210 of vessel 200. Barge 100 is secured to vessel 200 by means of attractive force attachment elements 180.

Figure 11:
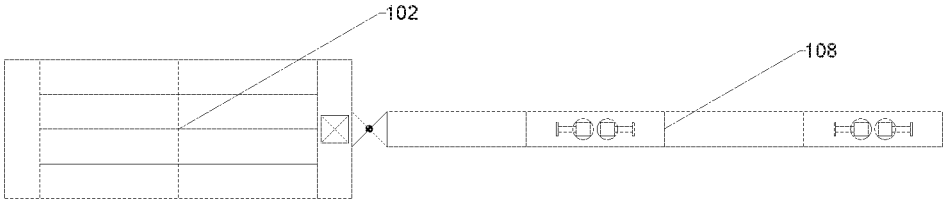
FIG. 11 shows a single auxiliary section extended.

FIG. 11 shows yet another exemplary embodiment with barge 100 configured with a single auxiliary section 108. In this example, auxiliary element 108 is shown extended for transportation and/or storage.

REFERENCE NUMERALS

50 Wharf
100 Servicing Watercraft or Barge
102 Main Section of Servicing Watercraft
108 Single Auxiliary Section

110 Port (Left) Auxiliary Section (Wing)
120 Starboard (Right) Auxiliary Section (Wing)
130 Linear Actuator
140 Rotary Actuator
160 Port (Left) Auxiliary Section (Wing) Mount
161 Port (Left) Auxiliary Section (Wing) Joint
162 Starboard (Right) Auxiliary Section (Wing) Mount
163 Starboard (Right) Auxiliary Section (Wing) Joint
170 Fender System
172 Fender of Forward (Front) Aspect of the Main Section of the Servicing Watercraft
174 Fender of Auxiliary Sections (Wings)
176 Fender, Aft (Rear) Main Section of Servicing Watercraft
180 Attractive Force Attachment Element
190 Vertical Structure
200 Serviced Watercraft, or Vessel, or Oceangoing Vessel (OGV)
210 Superstructure
220 Exhaust Pipes
230 Funnel
300 Cargo or Shipping container, example located forward relative to the superstructure
310 Cargo or Shipping container, example located aft relative to the superstructure
400 Tower
500 Arm

OPERATION

In one exemplary embodiment, as shown in FIG. 9, the rotation of each wing may be urged by linear actuator 130 between barge main section 102 and wing 110 and linear actuator 130 between barge main section 102 and wing 120. Each wing is designed to operate, but not limited to, within the range of zero to 180 degrees. FIG. 9 shows one wing deployed to 90 degrees and another wing deployed to 180 degrees. Each linear actuator is located appropriately to accommodate said range of motion. Each linear actuator has sufficient strength to counteract the forces imposed by relative motion between the two watercrafts, waves, wakes, and/or swells encountered during operations. The linear actuator may be hydraulic or electrical, among other examples. The linear actuator is composed of suitable materials for a marine environment.

In another exemplary embodiment, as shown in FIG. 7, the rotation of each wing may be urged by rotary actuator 140. The rotary actuator could operate directly in the same axis as pivot 160 or pivot 162 or the rotary movement could be urged with pulleys, chains, or gears, for example, to a remote linear or rotary actuator. Rotary actuator 140 may operate each wing within a range, but not limited to, between zero and 180 degrees, rotary actuator 140 is sufficiently strong to counteract the forces encountered during operations due to relative motion between the watercraft, waves, wakes, or swells. Rotary actuator 140 may be hydraulically powered or electrically powered, for example. The materials used in rotary actuator are suitable for a marine environment.

The wing rotation actuators, may be controlled locally with controls located at the actuator, and/or with at least one remotely-located control panel located anywhere on the deck of barge 100 or in the wheel house or control room of barge 100.

Alternatively, in yet another exemplary embodiment, each wing may be urged directly by cables. The cables may be rope or steel cable or any other type of cable that has sufficient strength, flexibility, and durability for this purpose in a marine environment. In this example, at least one cable would pull each wing into the deployed position and while at least one other cable would pull in the opposite direction such that sufficient tension is maintained in all cables to maintain the position of each wing. Leverage may be required at the pivot, for example, in order to have sufficient leverage for the cable to react against. Each cable may be manipulated by hand by deck hands, and/or assisted with at least one tensioning device such as a power wench, windlass, or capstan, for example.

With at least one wing deployed as shown in FIG. 1, for example, barge 100 has an advantage of increased stability in waters with swells and waves as compared to the configuration shown in FIG. 3. Watercraft rolling motion is inversely related to the width of the watercraft. The angle of roll is roughly the inverse tangent of the height of the swell divided by the width of a watercraft. Thus, typical slender hulls therefore exhibit significant rolling motion in the longitudinal axis because of the narrow width of the hull. When one or more wings are deployed on barge 100, the effective width of barge 100 is increased, thereby enjoying an advantage of reduced rolling motion, thus reducing the relative motion between the watercraft. In one of many possible examples, the effective width of barge 100 increases from about 60 feet (with wings alongside) to more than 240 feet (with two wings deployed) thus significantly reducing the rolling motion up to a factor of four in this example.

Each wing of barge 100 exists in one of two general modes of operation: a) deployed (wings positioned away from main section 102 as shown in the example of FIG. 1) OR b) stowed (wings alongside main section 102 as shown in FIG. 3). Other than during drifting or maneuvering, barge 100 will typically not be traveling through the water when the wings are deployed. The wings will normally be deployed when barge 100 is operating near vessel 200. Conversely, the wings are typically stowed for transportation or storage.

The operational flexibility of barge 100 provides many configuration options that may be used depending on the circumstances that are encountered:

a) As one of many examples, as shown in FIG. 4, none of the wings need be deployed when operating next to vessel 200. Barge 100 enjoys the freedom to be used in the same fashion that typical barges are used, i.e. side-by-side with vessel 200. This operational flexibility of barge 100 provides this option that may be used when barge 100 is utilized in a narrow waterway, and/or while operating in calm waters, and/or while operating next a vessel that is not a cargo ship.

b) In another example, if a watercraft were to be positioned as shown in FIG. 5, where the watercraft is positioned perpendicular to vessel 200 without wings deployed—resembling a typical barge. However, there would be insufficient contact at the bow of barge 100 to prevent rotation about the watercraft's vertical axis during operation. Securing watercraft 100 with cables in this orientation is dangerous, especially if there are currents urging the watercraft to move or rotate. Furthermore, there would be unacceptable relative motion between the two watercrafts.

c) In yet another example, each wing may be individually positioned at any angle between zero and 180 degrees or more, to adapt to any given situation.

d) In yet another example, one wing is deployed about 90 degrees while the other wing is stowed. Only one wing is typically necessary to be deployed during coupling for sufficient stability. However, as more wings are deployed, the more stable the watercraft. Furthermore, deployment of each additional wing would provide a more secure coupling if each additional wing is able to make contact with vertical aspects of the serviced watercraft.

e) In yet another example, two wings are deployed about 180 degrees away from the main section 102 with the wings making contact with both the port and starboard sides of vessel 200 while the barge 100 is positioned at the stern of vessel 200. This configuration is especially useful for operations of petrochemical tankers which may have additional requirements for positioning of barge 100 away from petrochemical storage tanks that are typically located forward of the superstructure for reasons of fire safety.

f) In yet another example, as shown in FIG. 9, wing 110 may be deployed to 90 degrees and thereby securing to a side of the serviced watercraft and wing 120 may be deployed to 180 degrees to be parallel to the stern of the serviced watercraft thereby securing to the transom, the vertical section across the stern (rear) of the serviced watercraft. In this configuration, there would be tremendous stability (reduced rolling) in both axes with each arm along each axis.

g) In yet another example, at least one wing may be deployed to provide additional mooring options when barge 100 is secured to a wharf or pier or some other grounded or floating structure. Furthermore, this example configuration could allow other vessels to moor perpendicular to the wharf, pier, or structure side-to-side with barge 100 in order to accommodate additional watercraft into a limited space.

h) In yet another example, barge 100 is enabled to position main section 102 next the superstructure of vessel 200 in a perpendicular orientation to vessel 200 while maintaining contact with the vertical aspects of the hull of vessel 200 with at least one of the wings. Barge 100 typically needs to be placed adjacent to the superstructure (house) on of vessel 200 because this is where the engine room is located and this is where fuel connections, supply cranes, and exhaust pipes are located. On many vessels, the superstructure is located near the stern (rear) of the vessel, especially on non-containerships such as bulk carriers, tankers, Roll on/Roll off (RoRo's), and auto carriers. If vessel 200 is lightly loaded and therefore sits high in the water, the stern (the run) has a sharp rake (a rounded incline from perpendicular) and there is not a flat area (sheer strakes) where the vessel can securely come alongside for coupling that is near the superstructure. The advantage of a deployed wing is that the wing can be adjusted to maintain contact with the hull of vessel 200 as it raises and lowers in the water due to cargo loading and offloading and/or changes in ballast, thus assuring a robust and secure coupling position.

i) In yet another example, wing 110 and wing 120 may be positioned so that another servicing watercraft could operate concurrently next to servicing barge 100. One of many examples is when both an emissions control barge and a bunkering (fueling) barge both need access to the same serviced vessel 200. In one of many examples, the emissions control barge 100 could position wing 120 next to the other serving watercraft at zero degrees to make room for the other servicing watercraft while extending wing 110 at 90 degrees to make sufficiently-secure contact with the serviced vessel 200.

Once barge 100 and vessel 200 are oriented next to each other in one of the configurations described above, for example, then the two watercrafts may be coupled together for the duration of the operations. Some examples follow:

a) In one exemplary embodiment, the most common method is to couple with lines, which are cables or ropes commonly used for this purpose. Lines or ropes are used in combination with the usual cleats, chocks, bits, bollards, etc. so that the lines are in the proper orientation to substantially limit relative movement between the two watercrafts. Barge 100 has sufficient hardware (cleats, chocks, bits, bollards, etc.) located throughout main section 102 and each wing. The lines are typically pulled tight with sufficient tension manually and/or with the aid of a power windlass, power winch, power capstan, or similar.

b) In another exemplary embodiment, as shown in FIG. 8, each wing of barge 100 may support metal vertical structure 190. Along these vertical structures would be at least one attractive force attachment element 180 (e.g. a vacuum cup or magnetic pad) that would secure to vessel 200. Each attractive force attachment element 180 could optionally slide up and down on said structure 190. Each attractive force attachment element 180 could optionally be part of a commercially-available mechanism, e.g. sourced from Cavotec or similar, with means to accommodate the change in relative positioning of barge 100 to vessel 200. Vertical structure 190 is sufficiently tall to be able to enable placement of attractive force attachment element 180 on a vertical flat section of the vessel, whereas the area below may not be vertical as the hull of vessel 200 rounds. Each attractive force attachment element 180 is provided with a means to also allow vessel 200 to rise and fall while barge 100 is secured to vessel 200.

Fenders are used to create a soft interface between barge 100 and vessel 200. Fenders are required in each location where contact between barge 100 and vessel 200 is anticipated. Thus, fenders may line some or all of the outer edges of main section 102 and wing 110 and wing 120. The fendering system must a) maintain a suitable distance between barge 100 and vessel 200, b) provide a soft interface to prevent damage to painted metal surface of either watercraft, c) be durable enough to absorb the constant relative motion between the watercraft, and d) absorb the constant impact from the frequent shocks caused by relative motion between the watercraft, waves, swells, and/or wakes from other vessels. Optionally, the fendering system may also provide a counter force to the tension of the lines and/or prevent slack in the lines.

Following are some exemplary embodiments of fenders:

a) In one exemplary embodiment, tires may be used as fenders, which are cheap and plentiful, but have limited utility.

b) In another exemplary embodiment, D-shaped fenders made of a resilient, rubber-like material may be used as fenders. The inside of the "D" shape is filled with air and the rubber-like material is firm enough to roughly maintain the "D" shape. Note: P-shaped fenders could also be used. This type of fender is not capable of a large amount of relative motion.

c) In another exemplary embodiment, large floating fenders, such as that produced under U.S. Pat. No. 3,063,400A by Yamaguchi Minoru and Kobayashi Takashi and assigned to Yokohama Rubber Co Ltd may be used. These types of fenders are commonly referred to in the marine industry as "Yokohamas". This type of fender is helpful when there is a large gap between the vessels and there is a large amount of motion.

All the components of the coupling system work together to form a complementary system that provides safe and secure coupling between the two watercraft.

The above description is intended to enable the person skilled in the art to practice the invention. It is not intended to detail all of the possible modifications and variations that will become apparent to the skilled worker upon reading the description. It is intended, however, that all such modifications and variations be included within the scope of the invention that is seen in the above description and otherwise defined by the following claims.

CONCLUSION, RAMIFICATIONS, AND SCOPE

Accordingly, the reader will see that a servicing watercraft that may be safely and effectively secured to another watercraft. Thus, the reader will see that at least one embodiment provides the following advantages:

A servicing watercraft that utilizes a sufficiently thin auxiliary section that can be positioned away from the main section of the servicing watercraft such that only the thin auxiliary section is placed under the hazardous section of a serviced watercraft. Therefore, if cargo were to fall from the serviced watercraft, it would fall past the thin auxiliary section, splashing into the water instead of impacting the main section of the servicing watercraft. This eliminates the need for a spacer, thereby providing the following advantages:

a) The main section of the servicing watercraft is positioned away from the danger of falling cargo, thereby increasing safety, and reducing the risk damage, injury, or death from falling cargo.
b) Decreases the reach required for an arm that would otherwise have to span between the servicing watercraft and the serviced watercraft, thereby reducing cost of the arm and increasing the width of vessels that may be serviced by a distance equal to the width of the eliminated spacer.
c) Eliminates the time and expense for a second watercraft or tugboat to transport a spacer to the servicing location.
d) Eliminates the need to store said spacer in a separate location than the servicing watercraft, thereby reducing slip fees.
e) Eliminates the expense of said spacer.
f) Eliminates the need for an additional tugboat to position and manipulate said spacer barge into position, thereby saving time and operating costs.
g) An auxiliary section can be positioned quickly, compared to a separate spacer barge, thereby reducing the amount of time necessary, thereby reducing operating costs and increasing revenue.
h) Reduces the distance that the servicing watercraft intrudes into the water space of a narrow channel which could otherwise cause interference with other vessels that pass by.

At least one auxiliary section may be positioned so to increase the effective width of a servicing watercraft thus providing the following advantages:

a) Reduction in the amount of rolling motion when the watercraft is exposed to swells, wakes, and waves, thus reducing the amount of relative motion between the servicing watercraft and the serviced watercraft, thereby increasing safety.
b) Eliminating the need that the servicing watercraft be built with a fixed increased width, thus reducing the cost of said servicing watercraft.

At least one auxiliary section of a servicing watercraft may be positioned to decrease the effective width of the watercraft thus providing the following advantages:

a) Eliminating the requirement for a fixed extra-wide watercraft thus reducing the drag when the watercraft moves through the water, thereby reducing fuel cost.
b) Allowing the servicing watercraft to better navigate through narrow channels and waterways.
c) Allowing other watercraft to pass when the servicing watercraft operates in narrow channels and waterways.

At least one auxiliary section may be positioned adjacent to a section of the hull on a serviced watercraft that is a vertical surface, whereby the auxiliary section supports the main section of a servicing watercraft, even in the case where the main section of the servicing watercraft is not in full contact with the hull of the serviced watercraft, thus providing the following advantages:

a) Eliminating the need to use floating fenders on the non-vertical sections of the serviced watercraft. Floating fenders are inconvenient, are complicated, take up space on the deck, and are time-consuming.
b) Eliminating the need to constantly adjust at least one floating fender when the serviced watercraft raises or lowers in the water due to cargo loading and offloading and/or changes in ballast.
c) Maintaining secure coupling between the servicing watercraft and the serviced watercraft while the serviced watercraft raises or lowers in the water due to cargo loading and offloading and/or changes in ballast.
d) Maximizing the area of contact with the available vertical surfaces on the hull of the serviced watercraft, thus providing a robust and secure coupling between the servicing watercraft and the serviced watercraft.
e) The main section of the servicing watercraft may be positioned away from the sections of the serviced watercraft that handle cargo, thus reducing the risk of falling cargo impacting the servicing watercraft. The safest location is typically adjacent to the superstructure of the serviced watercraft. However, on some vessels, the hull adjacent to the superstructure may not be vertical.
f) The main section of the servicing watercraft may be positioned in the optimum location, even where there is limited or no vertical hull surface, while being supported by the offset auxiliary section which continues to be secured to an adjacent vertical aspect of the hull of the serviced watercraft, thereby reducing the arm reach required, which enables servicing wider vessels and reduces the cost of the arm.

A servicing watercraft may be oriented perpendicular to a serviced watercraft so that an arm may originate near the edge of the servicing watercraft that is adjacent to the serviced watercraft thereby eliminating the additional reach that would have otherwise been required for the arm to reach over half the width of the servicing watercraft, thereby increasing the net reach of the arm and/or reducing the cost of the arm and increasing the number of vessels that may be serviced.

A system that enables a watercraft to couple to another watercraft in waters with large swells, wakes, or waves such as outside the harbor, outside the breakwater, or in an area inside the harbor that suffers from unusually large swells, wakes, or waves.

While the above detailed description contains many specificities, these should not be construed as limitations on the scope, but rather as an exemplification of one [or several] embodiment(s) thereof. Many other variations are possible. For example, In an exemplary embodiment, as shown in FIG. 10 and FIG. 11, an auxiliary section would attach at a pivot at the middle-front of the servicing watercraft which can swing left (port) or starboard (right). This embodiment has the advantage of only requiring a single swinging auxiliary section that could be positioned either "port-to" or "starboard-to". However, during transportation, this section would not be brought in alongside to the barge, but would instead extend straight out in front of (or behind) the barge.

In another exemplary embodiment, a separate floating section could be implemented as an alternative to the pivoting wings such that the floating section is kept with the main barge section loosely via lines, rope, or cables. In the non-deployed mode, the floating element would be manipulated to one of the sides or lifted to a storage location of the servicing watercraft. In deployed mode, the floating section could be manipulated to left-front, center-front, or right front of the servicing watercraft and secured. The floating section could be secured with rope or cable or by means of a mechanical attachment. The floating section may also be comprised of separate elements that may be attached together as required.

In yet another exemplary embodiment, the floating sections could stow in an angle up to vertical instead of horizontally.

In yet another exemplary embodiment, pontoons and/or outriggers at the end of swinging arms could be used instead of floating sections.

In yet another exemplary embodiment, the auxiliary section (wing) does not necessarily have to be floating section. The section may be cantilevered from the main section and may or may not include at least one supporting buoyant device along the cantilevered section.

In yet another exemplary embodiment, the servicing watercraft may be positioned nose-in to the side of the serviced watercraft and secured with lines, that is, the servicing watercraft is perpendicular to the serviced watercraft. Although this configuration moves the main section of the servicing watercraft away from falling cargo, falling cargo could still impact the lines, which would still cause damage to the servicing watercraft and/or serviced watercraft. This configuration would also not reduce the rolling motion of the servicing watercraft.

In yet another exemplary embodiment, the servicing watercraft uses at least one crane to stow the auxiliary section(s) until needed. When the servicing watercraft and the serviced watercraft are about to be secured together, at least one crane moves the auxiliary section(s) from the stowage location to the operating location. The auxiliary section(s) are secured, as several of many possible examples, with lines, ropes, cables, and/or mechanical mechanisms.

I claim:

1. A method for securing a servicing watercraft to a serviced watercraft, wherein said servicing watercraft comprises a main section and at least one buoyant auxiliary section pivotably attached to said main section, wherein said auxiliary section(s) may be positioned relative to said main section, wherein said main section comprises a bow and a stern, wherein said serviced watercraft comprises a hull, a superstructure, and at least one cargo section, said method comprising: positioning said bow of said servicing watercraft to make contact with said serviced watercraft adjacent to said superstructure and away from said cargo section and positioning said auxiliary section(s) to increase the effective width of the servicing watercraft, thereby reducing the risk of impact from falling cargo from said serviced watercraft.

* * * * *